US007451811B2

(12) United States Patent
Lohbeck et al.

(10) Patent No.: US 7,451,811 B2
(45) Date of Patent: Nov. 18, 2008

(54) EXPANDING A TUBULAR ELEMENT TO DIFFERENT INNER DIAMETERS

(75) Inventors: Wilhelmus Christianus Lohbeck, Rijswijk (NL); Paul Dirk Schilte, Rijswijk (NL); Djurre Hans Zijsling, Rijswijk (NL)

(73) Assignee: Shell Oil Company, Houston, TX (US)

( * ) Notice: Subject to any disclaimer, the term of this patent is extended or adjusted under 35 U.S.C. 154(b) by 180 days.

(21) Appl. No.: 10/563,505

(22) PCT Filed: Jul. 6, 2004

(86) PCT No.: PCT/EP2004/051364

§ 371 (c)(1),
(2), (4) Date: Jan. 5, 2006

(87) PCT Pub. No.: WO2005/005772

PCT Pub. Date: Jan. 20, 2005

(65) Prior Publication Data

US 2006/0162938 A1 Jul. 27, 2006

(30) Foreign Application Priority Data

Jul. 7, 2003 (EP) ..... 03254300

(51) Int. Cl.
*E21B 19/16* (2006.01)

(52) U.S. Cl. ..... 166/207; 166/206; 166/380

(58) Field of Classification Search ..... 166/207, 166/206, 212, 384, 380
See application file for complete search history.

(56) References Cited

U.S. PATENT DOCUMENTS

| | | | | |
|---|---|---|---|---|
| 5,348,095 | A | 9/1994 | Worrall et al. | 166/380 |
| 6,070,671 | A | 6/2000 | Cumming et al. | 166/381 |
| 6,575,250 | B1 | 6/2003 | Wijsman | 166/380 |
| 6,772,836 | B2 * | 8/2004 | Schetky et al. | 166/277 |
| 2005/0011650 | A1 * | 1/2005 | Harrall et al. | 166/380 |

FOREIGN PATENT DOCUMENTS

| | | |
|---|---|---|
| GB | 2368082 | 4/2002 |
| WO | 03/006788 | 1/2003 |
| WO | WO 03029607 A1 * | 4/2003 |

* cited by examiner

*Primary Examiner*—Jennifer H Gay
*Assistant Examiner*—Brad Harcourt

(57) ABSTRACT

A method of expanding a tubular element is provided, the tubular element having a first portion to be expanded to a first inner diameter and a second portion to be expanded to a second inner diameter larger than the first inner diameter. The method comprising:

a) arranging an expandable sleeve of selected wall thickness in said second tubular element portion;

b) positioning an expander in the tubular element;

c) operating the expander so as to expand said first tubular element portion to the first inner diameter, and operating the expander so as to expand the sleeve to an inner diameter substantially equal to the second inner diameter minus double the wall thickness of the sleeve; and d) retrieving the sleeve from the tubular element.

12 Claims, 6 Drawing Sheets

EXPANDING A TUBULAR ELEMENT TO DIFFERENT INNER DIAMETERS

PRIORITY CLAIM

The present application claims priority on European Patent Application 03254300.1 filed Jul. 7, 2003.

1. Field of the Invention

The present invention relates to a method of expanding a tubular element having a first portion to be expanded to a first inner diameter and a second portion to be expanded to a second inner diameter larger than the first inner diameter.

2. Background of the Invention

Expandable tubular elements find increased application in the industry of wellbore construction, for example, in applications whereby the tubular element, after installation in the wellbore, is radially expanded to form a wellbore casing or liner. Typically the wellbore is drilled in sections, whereby after drilling each wellbore section a casing or liner is lowered in unexpanded state into the newly drilled wellbore section and subsequently radially expanded. Optionally the expanded casing/liner can be cemented in the wellbore by pumping a layer of cement between the casing/liner either before or after the expansion process.

Generally it will be required that subsequent casing or liner sections are interconnected in a manner that a fluid tight seal is obtained at the interconnection. This can be achieved, for example, by creating an overlap between subsequent sections of casing or liners such that an upper end portion of a lower casing section extends into a lower end portion of an upper casing section, either with or without a sleeve of deformable material there-between. Such overlap requires that the end portion of the tubular element into which the other tubular element extends, is expanded to a relatively large diameter. However, no reliable expansion method for achieving such result is available.

SUMMARY OF THE INVENTION

The present inventions include a method of expanding a tubular element having a first portion to be expanded to a first inner diameter and a second portion to be expanded to a second inner diameter larger than the first inner diameter, the method comprising:

a) arranging an expandable sleeve of selected wall thickness in said second tubular element portion;

b) positioning an expander in the tubular element;

c) operating the expander so as to expand said first tubular element portion to the first inner diameter, and operating the expander so as to expand the sleeve to an inner diameter substantially equal to the second inner diameter minus double the wall thickness of the sleeve; and d) retrieving the sleeve from the tubular element.

BRIEF DESCRIPTION OF THE DRAWINGS

The invention will be explained hereinafter in more detail by way of example with reference to the accompanying drawings in which.

DETAILED DESCRIPTION OF THE INVENTION

Figure 1A:
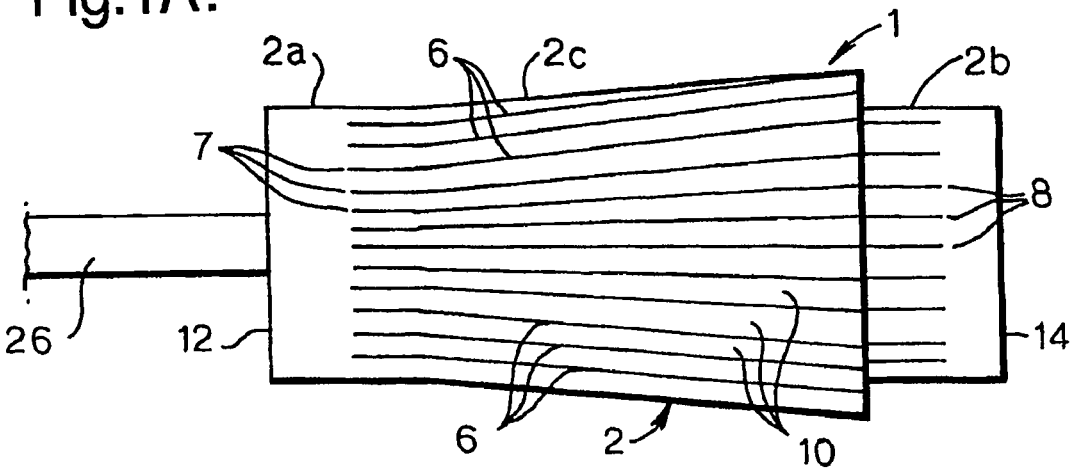
FIG. 1A schematically shows a side view of an expander when in retracted mode, used in an embodiment of the method of the invention.

In the drawings, like reference numerals relate to like components.

Figure 1B:
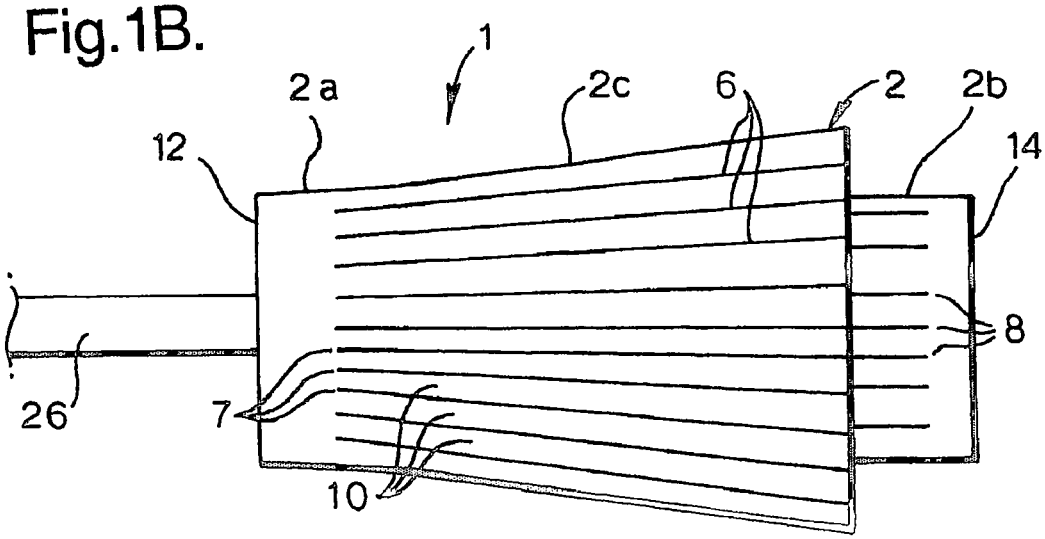
FIG. 1B schematically shows the expander of FIG. 1A when in expanded mode.
Figure 1C:
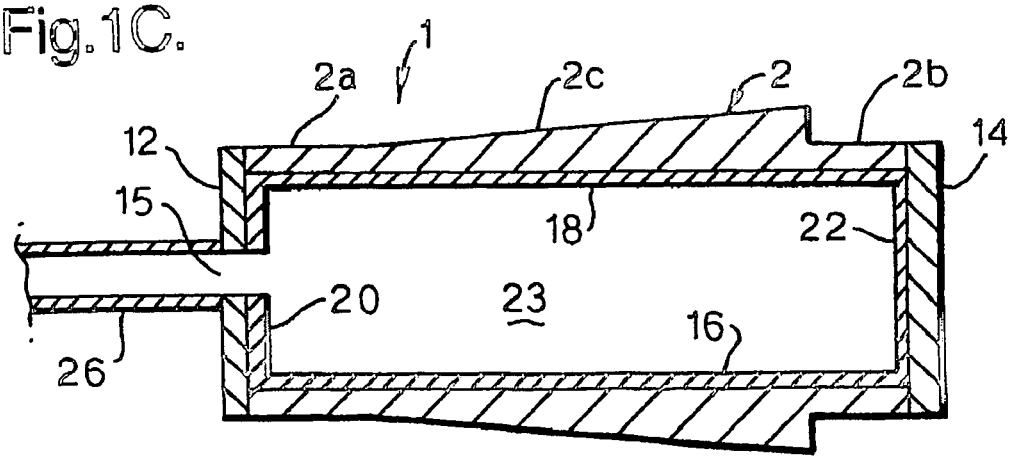
FIG. 1C schematically shows the expander of FIG. 1A in longitudinal section.

Referring to FIGS. 1A-C there is shown an expander 1 including a steel tubular expander body 2 having a front cylindrical part 2*a*, a rear cylindrical part 2*b*, and a tapering part 2c arranged between the cylindrical parts 2*a*, 2*b*. A plurality of narrow longitudinal slots 6 are provided in the expander body 2, which slots are regularly spaced along the circumference of the expander body 2. Each slot 6 extends radially through the wall of tubular expander body 2, and has opposite ends 7, 8 located at some distance from the respective ends of the expander body 2. The slots 6 define a plurality of longitudinal body segments 10 spaced along the circumference of the expander body 2, whereby each body segment 10 extends between a pair of adjacent slots 6 (and vice versa). By virtue of their elongate shape and elastic properties, the body segments 10 will elastically deform by bending radially outward upon application of a suitable radial load to the body segments 10. Thus the expander 1 is expandable from a radially retracted mode (FIG. 1A) whereby each body segment 10 is in its rest position, to a radially expanded mode (FIG. 1B) whereby each body segment 10 is in its radially outward bent position upon application of said radial load to the body segment 10.

The expander further includes cylindrical end closures 12, 14 arranged to close the respective ends of the expander body 2, each end closure 12, 14 being fixedly connected to the expander body 2, for example by suitable bolts (not shown). End closure 12 is provided with a through-opening 15.

An inflatable member in the form of elastomeric bladder 16 is arranged within the tubular expander body 2. The bladder 16 has a cylindrical wall 18 resting against the inner surface of the tubular expander body 2, and opposite end walls 20, 22 resting against the respective end closures 12, 14, thereby defining a fluid chamber 23 formed within the bladder 16. The end wall 20 is sealed to the end closure 12 and has a through-opening aligned with, and in fluid communication with, through-opening 15 of end closure 12. A fluid conduit 26 is at one end thereof in fluid communication with the fluid chamber 23 via through-opening 15. The fluid conduit 26 is at the other end thereof in fluid communication with a fluid control system (not shown) for controlling inflow of fluid to, and outflow of fluid from, the fluid chamber 23.

Figure 2:
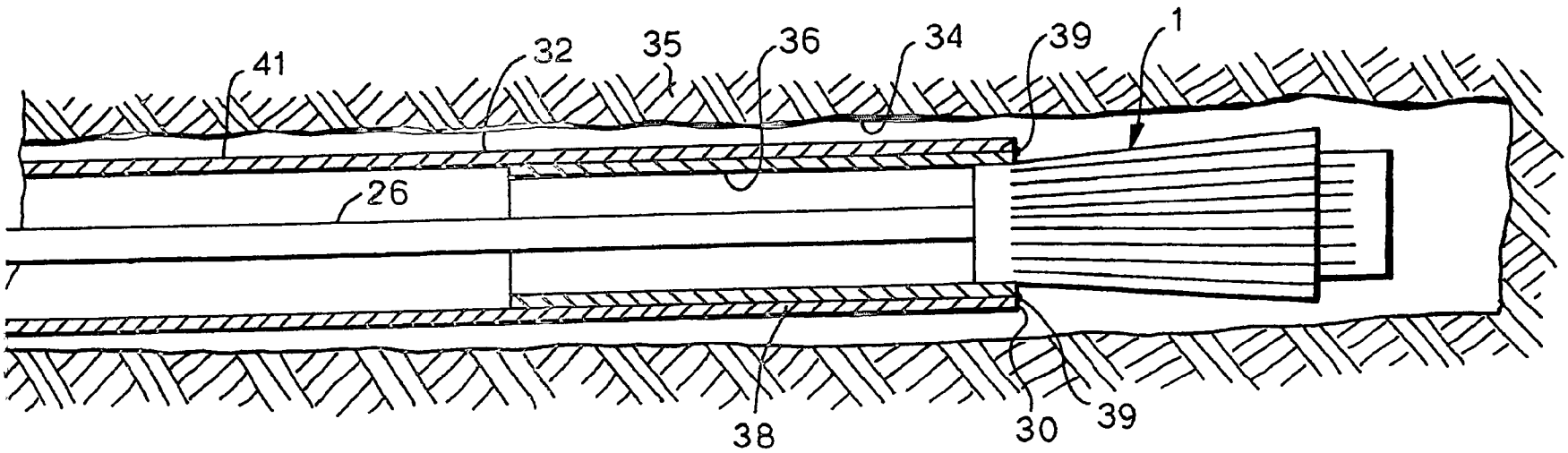
FIG. 2 schematically shows a first step in expansion of a tubular element.

Reference is further made to FIG. 2 showing the expander 1 arranged at the lower end 30 of a tubular casing 32 which extends into a wellbore 34 formed in an earth formation 35. The expander 1 is suspended from surface by a conduit 26. An expandable tubular sleeve 36 is arranged in a lower portion 38 of the casing 32 and temporarily fixed to the lower end 30 of the casing 32 by tack-welds 39 which should be strong enough to carry the weight of the sleeve 36 and to allow initial expansion of the sleeve 36 and lower casing portion 38. Hereinafter the lower casing portion 38 is referred to as the bell portion 38 of the casing, and the remainder of the casing 32 is referred to as the remainder casing portion 41. The front cylindrical part 2*a* of expander 1 extends into the sleeve 36.

Figure 3B:
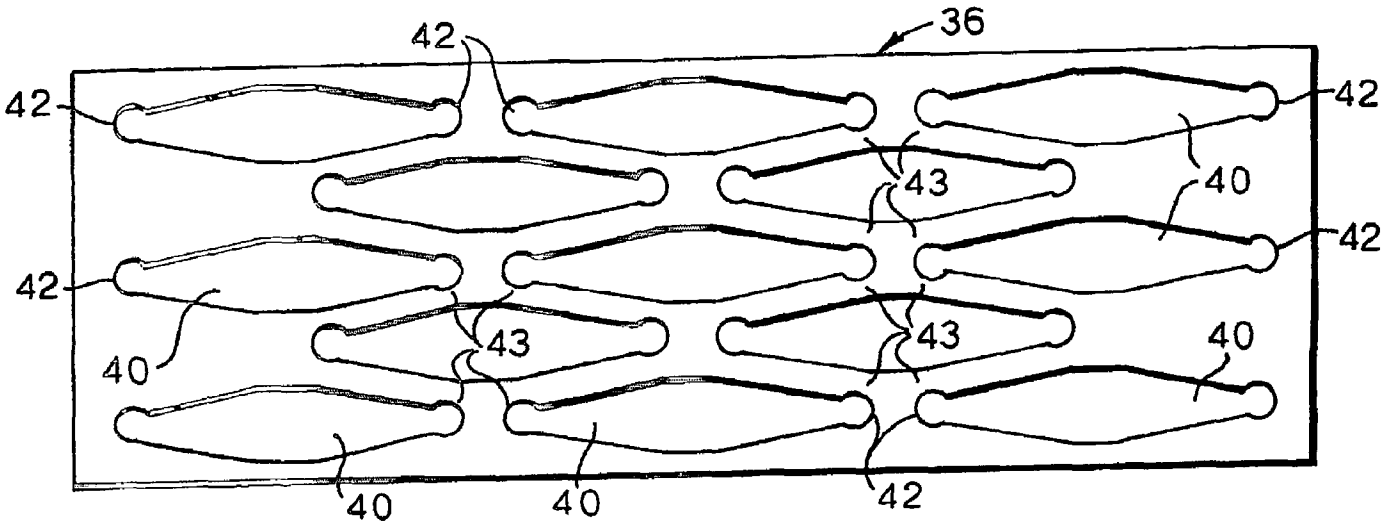
FIG. 3B schematically shows a side view of the sleeve of FIG. 3A after radial expansion thereof.
Figure 3A:
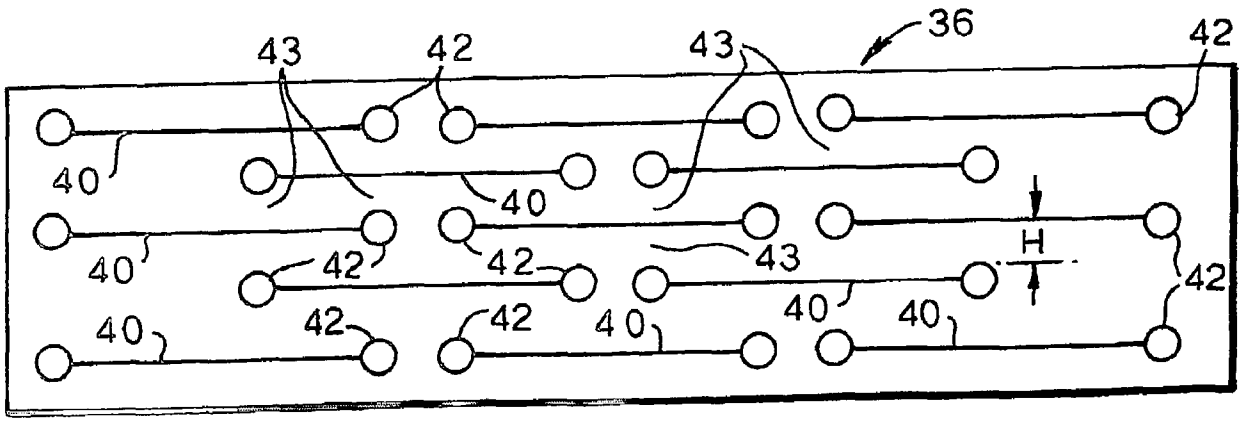
FIG. 3A schematically shows a side view of an expandable sleeve for use in the embodiment of the method of the invention.

The sleeve 36 is shown in more detail in FIGS. 3A and 3B, whereby FIG. 3A shows the sleeve 36 before radial expansion thereof, and FIG. 3B shows the sleeve 36 after radial expansion thereof. The wall of the sleeve 36 is provided with a plurality of through-openings in the form of slots 40 extending in axial direction. The slots 40 are arranged in rows of axially aligned slots, whereby adjacent rows are arranged staggered relative to each other so as to form a plurality of axially overlapping slots 40. Each slot 40 is at each end thereof provided with a circular hole 42. Plastic hinges 43 are formed by the wall portions of the sleeve 36 between each slot 40 and the respective adjacent holes 42. In FIG. 3A the width of each plastic hinge 43 is indicated by symbol H.

The resistance to bending of the hinges 43 is governed by their wall thickness and width H.

Figure 4:
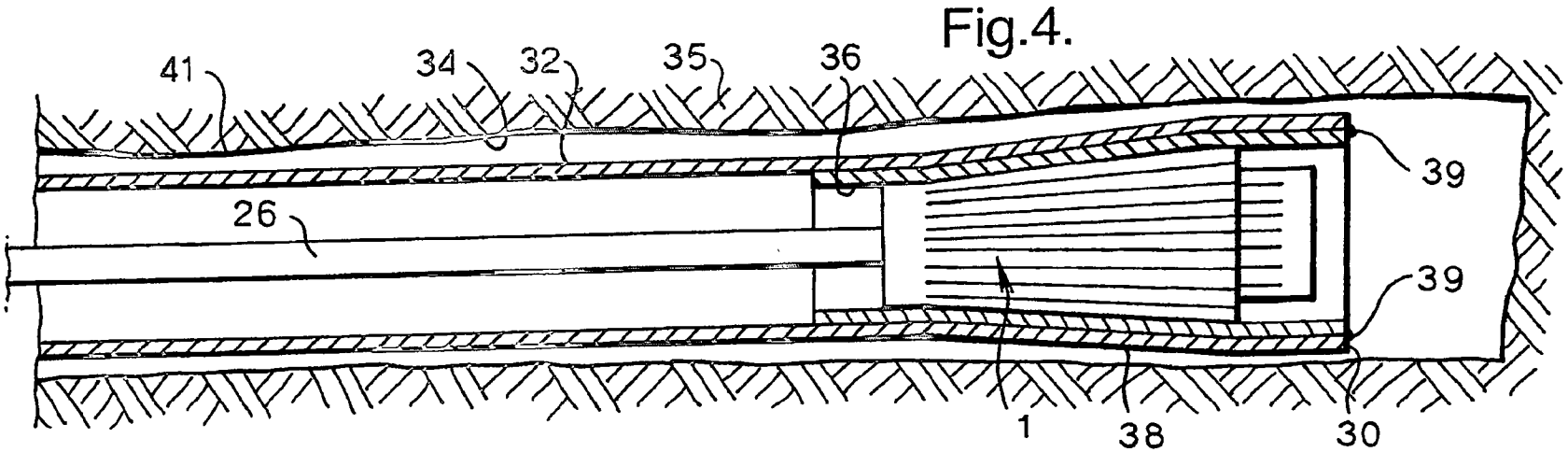
FIGS. 4-6 schematically show a sequence of steps in expansion of the tubular element of FIG. 2.

In FIG. 4, the expander 1 is located in the sleeve 36 whereby part of the sleeve 36 and part of the casing 32 have been radially expanded.

Figure 5:
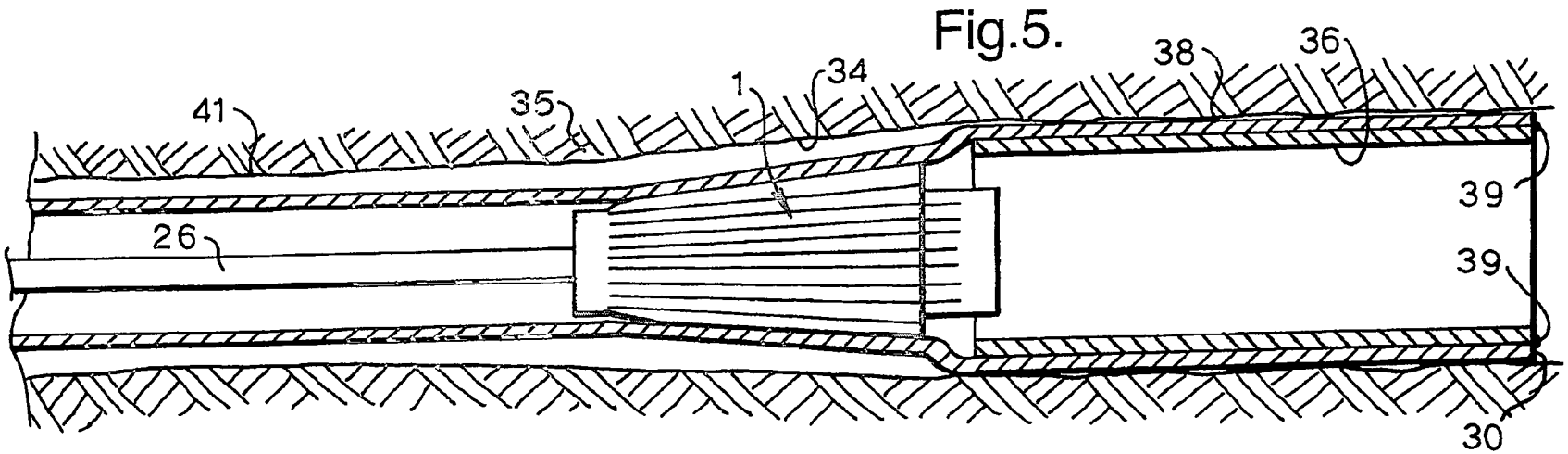

In FIG. 5, the expander 1 is located upwardly from the bell portion 38 whereby the sleeve 36, the bell portion 38 and part of the remainder casing portion 41 have been radially expanded.

Figure 6:
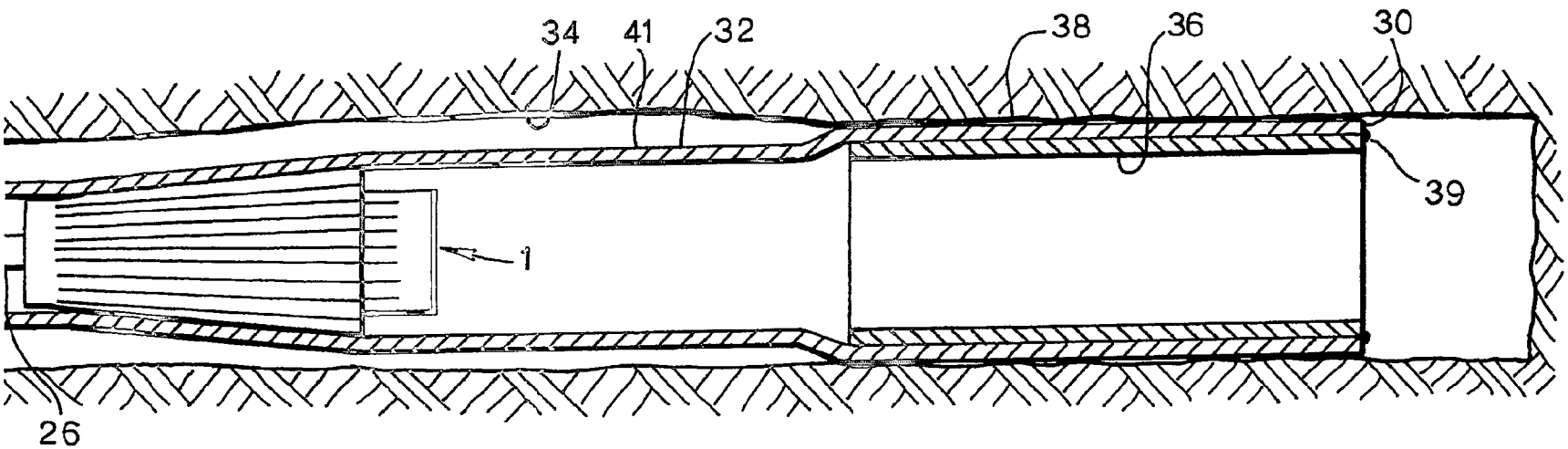

In FIG. 6, the expander 1 is located further upwardly from the bell portion 38 whereby the sleeve 36, the bell portion 38 and a further part of the remainder casing portion 41 have been radially expanded.

Figure 7A:
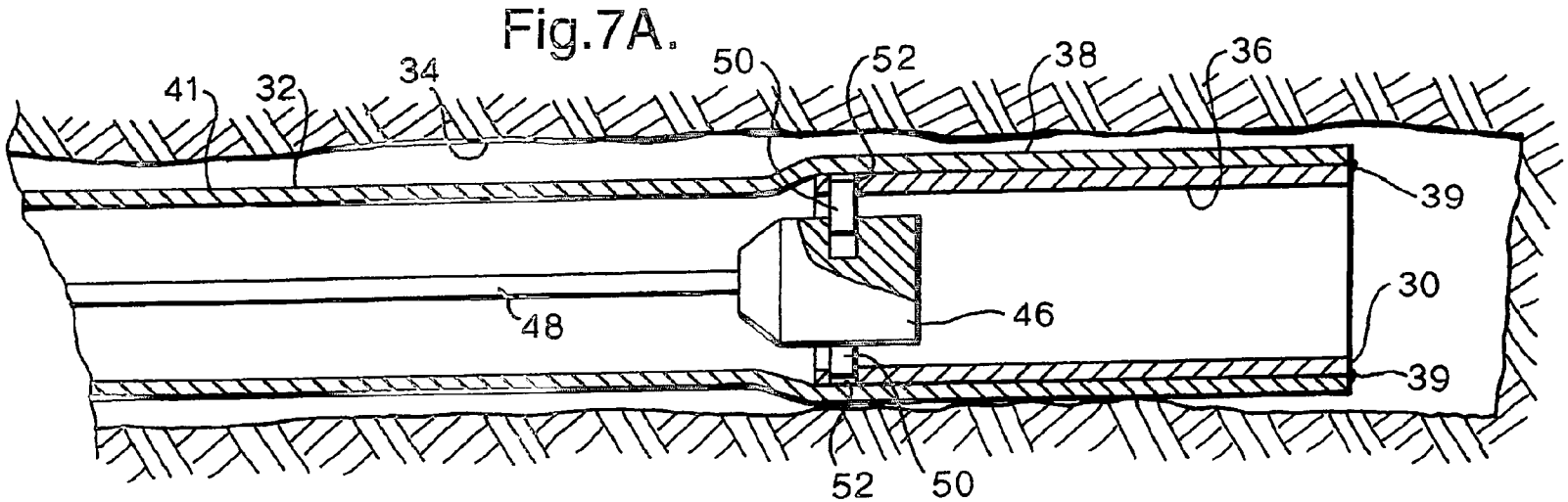
FIGS. 7A-B schematically show a retrieval tool positioned in the tubular element of FIG. 2.

Referring to FIG. 7A there is shown a retrieval tool 46 suspended from surface on a running string 48 extending into the casing 32. The retrieval tool 46 is provided with a number of radially extending spring-loaded pins 50 biased into corresponding openings 52 formed in the wall of the sleeve 36 so as to latch the retrieval tool 46 to the sleeve 36.

Figure 7B:
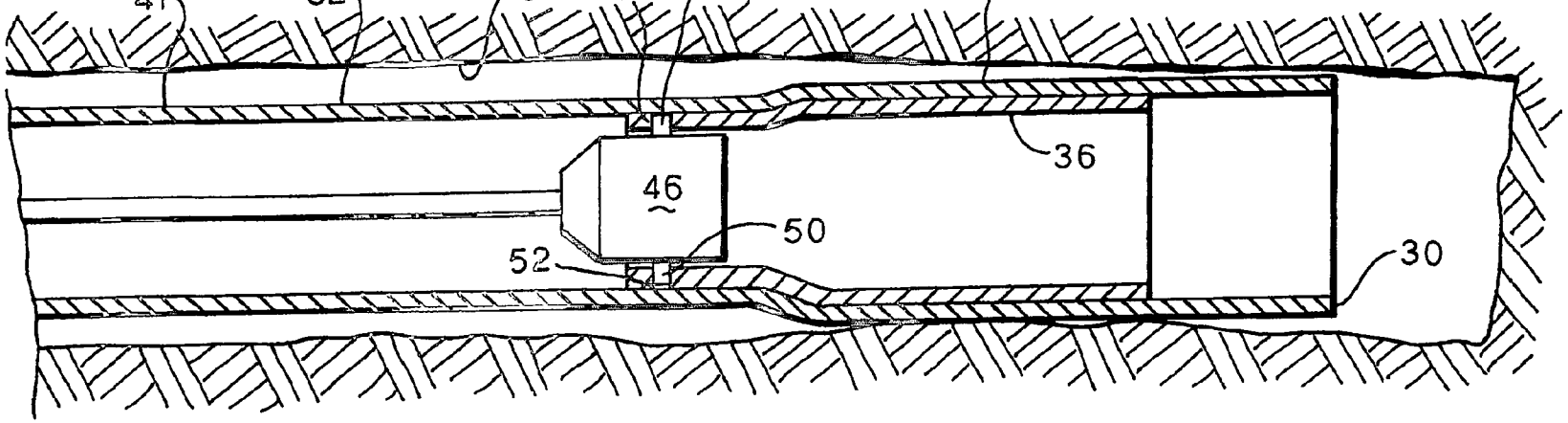

Referring to FIG. 7B there is shown the retrieval tool 46 latched to the sleeve 36 whereby the sleeve has been pulled upwardly a short distance through the casing 32.

During normal operation, the casing 32 is lowered into the wellbore 34 whereby the sleeve 34 and the expander 1 are arranged relative the casing.32 in the position shown in FIG. 2 whereby a moderate pulling force is exerted from surface to the expander 1 via conduit 26. Subsequently the casing 32 is radially expanded in a plurality of expansion cycles whereby each cycle includes a first stage and a second stage, as explained below.

In the first stage of the expansion cycle the fluid control system is operated to pump pressurised fluid, for example drilling fluid, via the conduit 26 into the fluid chamber 23 of the bladder 16. As a result the bladder 16 is inflated and thereby exerts a radially outward pressure against the body segments 10 which thereby. become elastically deformed by radially outward bending.

The volume of fluid pumped into the bladder 16 is selected such that any deformation of the body segment 10 remains within the elastic domain.

In order to promote uniform outward bending of the segments 10, the front part 2*a* of the expander body 2 is optionally provided with a ring or a sleeve (not shown) which limits outward bending of the segments 10.

Thus the body segments 10 revert to their initial positions after release of the fluid pressure in the bladder 16. Thus the expander 1 is expanded upon pumping of fluid into the bladder 16 from the radially retracted mode to the radially expanded mode thereof. As a result a short initial section of the casing 32 becomes plastically expanded.

In the second stage of the expansion cycle the fluid control system is operated to release the fluid pressure in the bladder 16 by allowing outflow of fluid from the bladder 16 back to the control system. The bladder 16 thereby deflates and the body segments 10 move back to their initial undeformed shape so that the expander 1 moves back to the radially unexpanded mode thereof. Optionally, the fluid pressure in the bladder is reduced to below the hydrostatic head, causing the segments to bend inwards. As a result the expander 1 is pulled by conduit 26 a short distance further into the sleeve 36.

Subsequently the above expansion cycle is repeated as many times as needed to expand successively the bell portion 38 of the casing and the remainder casing portion 41 or a desired length thereof.

During expansion of the bell portion 38 of the casing, the sleeve 36 is expanded simultaneously with the bell portion 38. Upon expansion of the sleeve 36, the plastic hinges 43 deform plastically. The wall sections between the respective hinges 43 rotate thereby opening-up the slots 40 (FIG. 3B). Such rotation causes the sleeve 36 to shorten, and the diameter increase of the sleeve 36 is accommodated by deformation of the hinges 43.

By virtue of opening-up of the slots 40, the expansion force required to expand the sleeve 36 is significantly lower than the force required to expand the casing 32. Therefore, simultaneous expansion of the sleeve 36 and the bell portion 38 of the casing 32 requires only a slightly higher force than the force required to expand the casing 32 only. It will be understood that the inner surface of the sleeve 36 and the inner surface of the remainder casing portion 41 are expanded to the same diameter. This implies that the inner surface of the bell portion 38 of the casing is expanded to a larger diameter than the inner surface of the remainder casing portion 41. The difference between the inner diameter of the bell portion 38 and the inner diameter of the remainder casing portion 41 after the expansion process, is substantially equal to twice the wall thickness of the sleeve 36. The wall thickness of the sleeve 36 does not change during expansion because the deformation is concentrated in the plastic hinges 43.

Furthermore, the sleeve 36 has a relatively large tendency to spring back after expansion because elastic relaxation of the sleeve is governed by elastic reverse bending of the hinges 43 rather than elastic contraction in circumferential direction as occurs in the casing 32.

The tack-welds 39 are sheared-off during expansion of the bell portion 38 due to differential axial shortening of the sleeve 36 and the bell portion 38 as a result of the expansion process.

Subsequent stages of the expansion process are shown in FIGS. 4-6 indicating gradual progression of the expander 1 through the casing 32.

After the casing 32 has been expanded, the expander 1 is removed from the casing and the retrieval tool 46 is lowered on running string 48 through the casing 32. Upon arrival of the retrieval tool 46 at the sleeve 36, lowering is slowly continued until the retrieval tool latches to the sleeve 36 by virtue of latching of the spring-loaded pins 50 into the openings 52 of the sleeve 36. The retrieval tool 46 is then pulled upwardly on running string 48.

As shown in FIG. 7B, the sleeve 36 is thereby radially compressed as it moves upwardly into the remainder casing portion 41. Compression of the sleeve 36 does not require a high compression force since such compression is accomplished by closing of the slots 50 of the sleeve 36. Furthermore, the tendency of the sleeve to spring back elastically, and the pulling force exerted to the sleeve by the retrieval tool, enable easy removal of the sleeve 36 from the casing 32. The sleeve 36 is finally removed from the casing 32 at the upper end thereof.

In this manner it is achieved that the lower portion of the casing 32 is expanded to a larger diameter than the remainder of the casing so that a subsequent casing (not shown) can be installed and expanded below the casing 32 whereby an upper end portion of the subsequent casing extends into the bell portion 38 of the casing 32.

Thereby an overlap is created between the casing 32 and the subsequent casing, which enables fixing and sealing of the casings to each other.

The resistance to expansion of the sleeve can be reduced further by reducing the width H of the hinges and/or by reducing the wall thickness of the sleeve at the hinges and/or by increasing the length of the slots.

Instead of fixing the sleeve to the casing by welding, the sleeve can be fixed to the casing by a layer of adhesive which fails upon differential movement between the sleeve and the casing during expansion. It is thereby ensured that the sleeve is secured in place until the entire sleeve has been expanded. Also the body segments can be spot-welded to the tubular element at their respective mid portions.

Instead of using the expander described above, a conventional expander cone can be used, for example an expander cone which is pulled, pumped or pushed through the casing.

Instead of using the retrieval tool described above, a retrieval tool can be used which is connected to the expander and therefore moves simultaneously with the expander through the casing. In such application the sleeve is removed from the casing simultaneously with expansion of the remainder casing portion.

Instead of the expander body being provided with slots having opposite ends near the respective ends of the expander body, the expander body can be provided with slots which extend only along a portion of the length of the expander body and which are arranged in a longitudinally overlapping arrangement. Such arrangement can be, for example, similar to the arrangement of the slots of the sleeve shown in FIGS. 3A, 3B.

In addition to operating the fluid control system so as to pump pressurised fluid via the conduit into the bladder, the fluid control system can be operated to exert suction to the bladder so as to extract fluid from the bladder causing inward bending of the segments of the expander body. In this manner the expansion ratio of the expander can be increased.

Instead of applying a sleeve with hinges which deform plastically, a sleeve can be applied with hinges which deform purely elastically, such as, for example, a sleeve made of shape memory metal.

Another example of a suitable sleeve is a sleeve provided with slots defining a pattern of bi-stable cells, each cell being capable of assuming a first stable configuration and a second stable configuration, whereby the sleeve has a larger inner diameter when the cells are in their respective second stable configurations than when the cells are in their respective first stable configurations. An example embodiment of such sleeve is the tube formed of bi-stable cells disclosed in GB-A-2368082.

We claim:

1. A method of expanding a tubular element having a first portion to be expanded to a first inner diameter and a second portion to be expanded to a second inner diameter larger than the first inner diameter, comprising:

a) arranging an expandable sleeve of selected wall thickness in said second portion;

b) positioning an expander in the tubular element;

c) operating the expander so as to expand said first portion to the first inner diameter, and operating the expander so as to expand the sleeve to an inner diameter substantially equal to the second inner diameter minus double the wall thickness of the sleeve; and d) retrieving the sleeve, including the portion of the sleeve that was expanded in step c), from the tubular element through the first portion, thereby reducing the diameter of the sleeve.

2. The method of claim 1, wherein the sleeve and the first tubular element portion are expanded to substantially the same inner diameter.

3. The method of claim 1, wherein the tubular element extends into a wellbore formed in an earth formation, and wherein said second portion is an end portion of the tubular element.

4. The method of claim 1, wherein the sleeve is provided with a plurality of openings defining a pattern of a plurality of members subjected to bending upon radial expansion of the sleeve.

5. The method of claim 4, wherein each said member includes a hinge section in which bending of the member is concentrated.

6. The method of claim 5, wherein said hinge section is subjected to elastic or plastic deformation upon radial expansion of the sleeve.

7. The method of claim 4, wherein said openings are slots extending in axial direction of the tubular element, and wherein adjacent slots are arranged in a longitudinally overlapping arrangement.

8. The method of claim 7, wherein each slot has opposite ends of enlarged width.

9. The method of claim 8, wherein said ends of each slot are formed by holes formed in the wall of the sleeve.

10. The method of claim 4, wherein step d) comprises moving the sleeve into said first tubular element portion thereby radially contracting the sleeve whereby said members are subjected to reverse bending.

11. The method of claim 1, wherein the sleeve is provided with latching means for latching a retrieval tool to the sleeve, and wherein step d) comprises passing the retrieval tool through the tubular element to the sleeve, latching the retrieval tool to the sleeve, and moving the retrieval tool with the sleeve latched thereto through the tubular element so as to retrieve the sleeve from the tubular element.

12. The method of claim 1, wherein the expander is operable to expand the tubular element by movement of the expander between a radially retracted mode thereof and a radially expanded mode thereof, and wherein step c) comprises:

i) moving the expander from the retracted mode to the expanded mode thereof so as to expand a section of said first tubular element portion or the sleeve;

ii) moving the expander from the expanded mode to the retracted mode thereof;

iii) moving the expander, or allowing the expander to move, axially through the tubular element into a further section of said first tubular element portion or the sleeve; and iv) repeating steps i)-iii) until the expander has expanded said first tubular element portion and the sleeve.

* * * * *